US005327469A

United States Patent [19]

Georgii

[11] Patent Number: 5,327,469

[45] Date of Patent: Jul. 5, 1994

[54] ARRANGEMENT FOR THE STORAGE OF ENVIRONMENTALLY HAZARDOUS WASTE

[75] Inventor: Hans Georgii, London, England

[73] Assignee: Hydro Beting AB, Stockholm, Sweden

[21] Appl. No.: 844,650

[22] PCT Filed: Oct. 9, 1989

[86] PCT No.: PCT/SE89/00551

§ 371 Date: Apr. 9, 1992

§ 102(e) Date: Apr. 9, 1992

[87] PCT Pub. No.: WO91/05351

PCT Pub. Date: Apr. 18, 1991

[51] Int. Cl.[5] ..... G21F 9/24

[52] U.S. Cl. ..... 376/272; 250/506.1; 114/257

[58] Field of Search ..... 376/272; 250/507.1, 250/506.1; 252/633; 588/250, 249; 114/257; 220/216; 405/8

[56] References Cited

U.S. PATENT DOCUMENTS

| | | | |
|---|---|---|---|
| 3,249,664 | 5/1966 | Georgii | 114/65 A |
| 3,760,753 | 9/1973 | Mertens | 376/272 |
| 3,917,953 | 11/1975 | Wodrich | 376/272 |
| 4,069,923 | 1/1978 | Blumenau et al. | 376/272 |
| 4,307,679 | 12/1981 | Goldsberry et al. | 252/633 |
| 4,800,062 | 1/1989 | Craig et al. | 376/272 |
| 4,889,681 | 12/1989 | Wachter et al. | 376/272 |

FOREIGN PATENT DOCUMENTS 149499 1/1984 Norway .

*Primary Examiner*—Daniel D. Wasil

*Attorney, Agent, or Firm*—Browdy and Neimark

[57] ABSTRACT

An arrangement for the underwater storage of environmentally hazardous waste, particularly radioactive or chemical waste, includes at least one secondary capsule (1) in the form of a cylindrical concrete body. The concrete body has a central, axially extending storage cavity (3). The cavity has the form of a shaft which is open at one end thereof and into which a waste-containing primary capsule (2) can be inserted, whereafter the open end of the shaft or cavity is sealed. Arranged in spaced relationship around the circumference of the concrete body (1) are a number of ballast chambers (4) which can be filled with water to varying degrees and the total, combined volume of the chambers is such as to enable the concrete body to be brought to a buoyant state, by emptying the chambers. A plurality of such secondary capsules (1) enclosing waste-containing primary capsules (2) can be stored on the sea bed in an annular concrete structure (6) which is provided with a large number of circumferentially distributed and vertically extending cylindrical compartments (9) each capable of accommodating a secondary capsule (1). The annular concrete structure (6) resting on the sea bed is also provided with a large number of ballast chambers which can be filled with water to varying degrees and which have a total, combined volume such as to enable the annular concrete structure to be brought to a buoyant state by emptying the ballast chambers.

10 Claims, 2 Drawing Sheets

ARRANGEMENT FOR THE STORAGE OF ENVIRONMENTALLY HAZARDOUS WASTE

The present invention relates to an arrangement for the storage of environmentally hazardous waste, and more particularly, but not exclusively, to an arrangement for the storage of radioactive or chemical waste.

The inventive arrangement is based on the offshore storage of waste of the aforesaid nature, i.e. underwater storage at relatively great depths. The invention provides several significant advantages over earlier proposed methods of storing such waste on land, in rock cavities and like storage facilities. For instance, the inventive offshore storage facility enables any leakages that may occur to be monitored and remedied much more easily than is the case with known facilities. Furthermore, the invention enables the use of considerably larger and heavier storage containers, each of which can thus accommodate a larger quantity of waste and afford greater security against the permeation of radiation from, e.g., radioactive waste.

Figure 1:
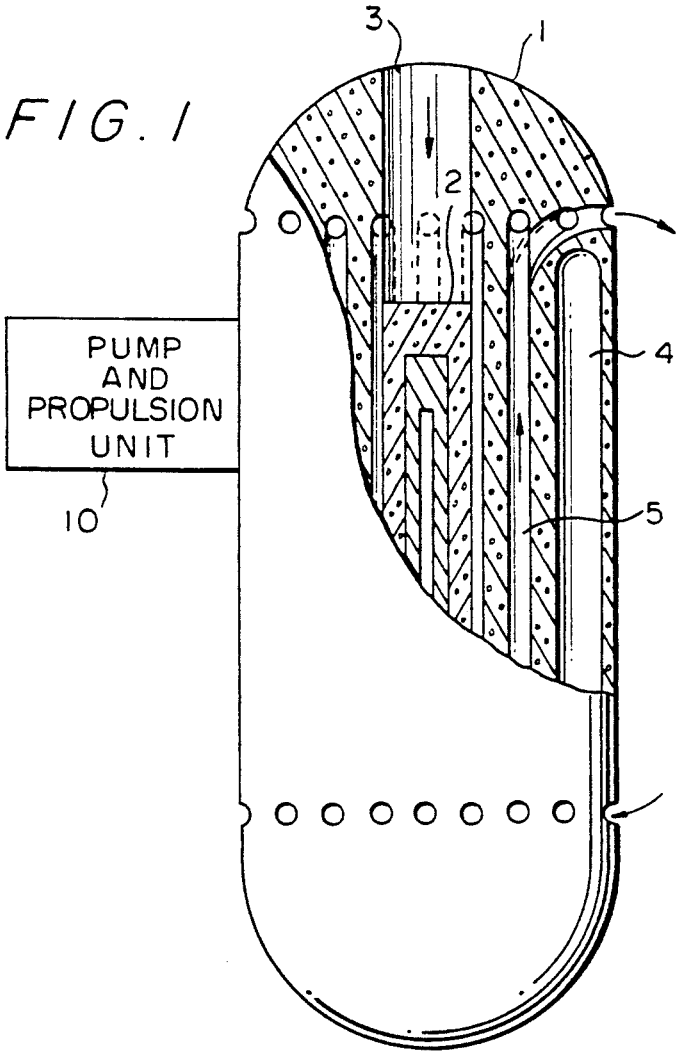
Figure 2:
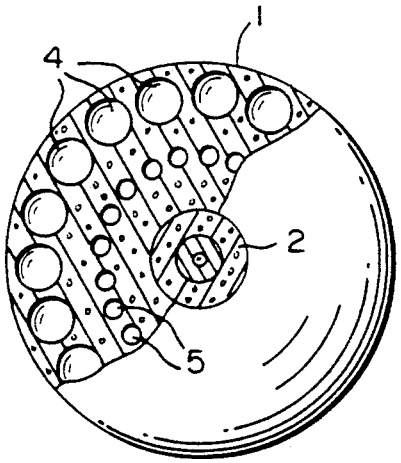
Figure 3:
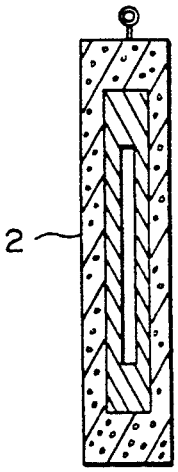
Figure 4:
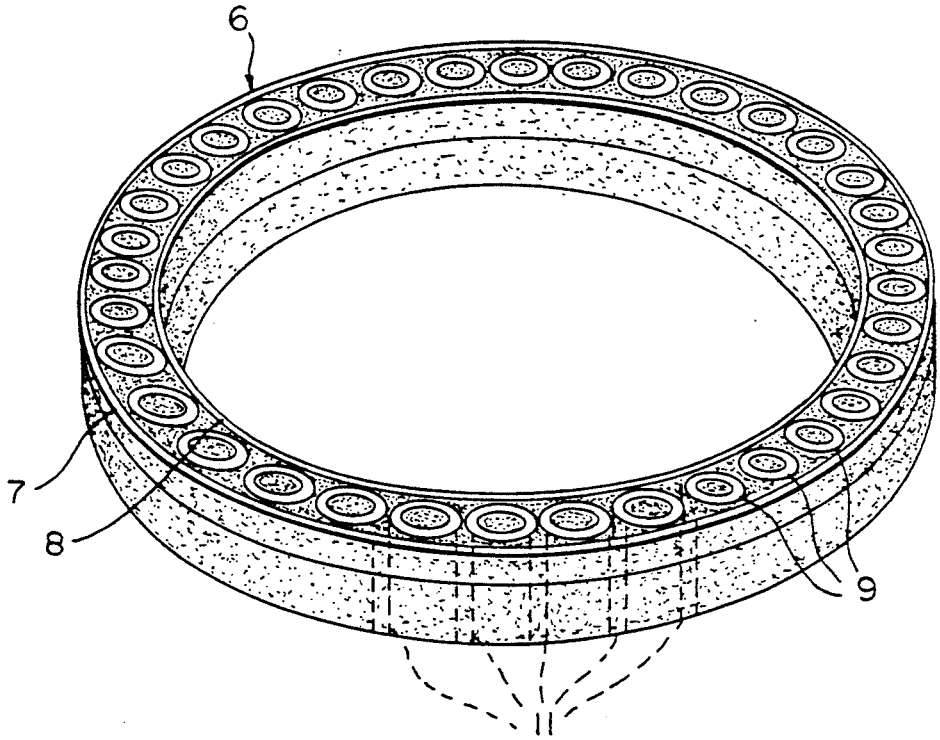

The invention will now be described in greater detail with reference to an exemplifying embodiment thereof illustrated in the accompanying drawings, in which FIG. 1 illustrates in side view, partly in axial section, an inventive concrete body which functions as a secondary capsule;

FIG. 2 is an end view, partly in radial section, of the concrete body shown in FIG. 1;

FIG. 3 illustrates schematically, and in axial section, a primary waste-storage capsule of appropriate conventional construction and intended to be placed in a secondary capsule of the kind illustrated in FIGS. 1 and 2; and FIG. 4 illustrates schematically an annular concrete structure which is intended to rest on the sea bed and which functions as a storage place for a plurality of secondary capsules according to FIGS. 1 and 2.

FIGS. 1 and 2 illustrate an exemplifying embodiment of the basic element of the inventive storage arrangement. The basic element comprises a secondary capsule 1 which is intended to accommodate and to seal a primary capsule 2 of, for instance, the configuration illustrated in FIG. 3, said primary capsule containing the environmentally hazardous waste, e.g. radioactive or chemical waste, to be stored. The primary capsule 2 may be of any appropriate, known design which will enable waste to be handled and transported from its place of origin to the secondary capsule 1 without danger to the environment from said waste.

The secondary capsule 1 consists of a concrete cylinder which, in the case of the illustrated embodiment has hemi-spherical ends. The illustrated concrete cylinder has a central storage cavity 3, which in the case of the illustrated embodiment has the form of a centrally located, axially extending hollow shaft which is open at one end and into which the primary capsule 2 can be inserted in the manner illustrated schematically in FIG. 1. The open end of the shaft is plugged or likewise sealed with concrete for example, subsequent to inserting the primary capsule into the shaft. An advantage is afforded when the open end of the shaft is plugged in a manner which will enable the plug to be removed readily at a later stage, e.g. by incorporating fracture weakening or the like in the plug, therewith to to enable the primary capsule to be removed.

The secondary capsule 1 is intended to be submerged permanently under water and to this end is configured with a plurality of internal ballast chambers 4 distributed circumferentially around the concrete cylinder. These chambers can be filled with water to varying degrees and the total volume of the chambers is such as to enable the secondary capsule 1, together with an inserted primary capsule 2, to float in the water and to be brought to different attitudes therein, e.g. with the longitudinal axis of the concrete cylinder extending vertically or horizontally. Consequently, since it is possible to control the effective "weight" of the secondary capsule 1 and also its attitude in the water, the secondary capsule 1 can be made very large and heavy without making it impossible to handle and move the capsule in water, such handling and movement of the capsule being a necessary factor. Because of its large dimensions and heavy weight, the secondary capsule 1 is able to accommodate a large quantity of waste. The secondary capsule is also mechanically strong and is highly insensitive to external influences. Furthermore, the secondary capsule will dampen significantly any radiation which may emanate from radioactive waste enclosed in the primary capsule for instance. A secondary capsule of the design illustrated by way of example in FIGS. 1 and 2 may, for instance, have an axial length of 40 m and a diameter of 16 m and a displacement of about 10000 tonnes. Naturally, the secondary capsule may have larger or smaller dimensions than those recited above.

When the secondary capsule 1 is intended for the storage of heat-emitting waste, the capsule may, advantageously, be provided with inner cooling channels 5 which extend axially in the concrete cylinder, with the channel orifices opening in the outer surface of the cylinder, as in the case of the embodiment illustrated in FIGS. 1 and 2. These cooling channels 5 are preferably located as close as possible to the storage cavity 3 and therewith the primary capsule 2. When the secondary capsule 1 is stored under water with the capsule axis substantially vertical, autocirculation of the water in the channels 5 will take place in the direction of the arrows shown, due to heating of the water present in said channels by the heat emitted from the waste in the primary capsule 2, therewith cooling the capsule.

The secondary capsule 1 can be transported in the water, for instance from a harbor to its ultimate storage location, in several different ways. The most natural method of transportation is to use tug boats of more or less conventional design. Another possible method resides in the use of special-duty vessels, possibly submersibles, which are coupled directly to the secondary capsule 1. A further possible method of transportation is to equip the secondary capsule 1 with a detachable unit 10 comprising the pumps and control apparatus required for varying and regulating the volume of water in the ballast chambers 4 and also with power generating devices, for instance in the form of water-jet propulsion motors, for movement of the secondary capsule in water.

The inventive secondary capsule can be manufactured in a dry dock or some corresponding facility, although the capsule may, advantageously, be manufactured directly in the water in accordance with the manufacturing principle described in U.S. Pat. No. 3,249,664.

The ultimate storage of the secondary capsules 1 enclosing waste-containing primary capsules 2 can be effected, advantageously, in an annular concrete construction resting on the sea bottom and being of the kind illustrated schematically by way of example in FIG. 4. This annular concrete structure comprises a single, coherent rigid unit and in the case of the illustrated embodiment has an outer cylindrical wall 7 and an inner cylindrical wall 8. Extending between the outer and inner walls 7,8 is a large number of cylindrical compartments 9 which are open at least at their upper ends, preferably at both ends, and which are firmly connected together and to the outer and inner walls 7,8 of the annulus. The cylindrical compartments 9 are so dimensioned that each compartment is able to accommodate a secondary capsule 1 of the aforedescribed kind. Storage of the secondary capsules 1 in the concrete annulus 6 can be likened to the storage of eggs in an egg carton. The concrete annulus 6 holds the secondary capsule safely in position and protects the capsules against external influences. The concrete annulus 6 incorporates in its cylindrical walls 7 and 8 and also in the walls of the cylindrical storage compartments 9 a large number of ballast chambers 11 some of which are shown schematically in FIG. 4 can be filled with water to varying degrees and which together have a total volume such as to enable the concrete annulus 6 as a whole to be brought to a boyant state in the water, by emptying the ballast chambers. Thus, the concrete annulus 6 can be manufactured in a place of manufacture, advantageously by means of the method described in the U.S. Pat. No. 3,249,664, and then towed to the intended waste-storage site and there submerged onto the sea bed, for instance at a location where the depth of water is some hundred meters.

Naturally, a concrete construction for the storage of a large number of secondary capsules on the sea bed need not necessarily have an annular configuration similar to the aforedescribed annulus illustrated in FIG. 4. The concrete construction may alternatively have a rectangular configuration which incorporates cylindrical storage compartments for secondary capsules over the whole of its area. In such cases, the egg-carton-like concrete structure will also include ballast chambers capable of being filled with water to varying degrees and enabling the whole of the concrete construction to be brought to a buoyant state. Concrete structures of other configurations are also possible of course.

The primary capsules which accommodate the waste-containing secondary capsules can also be stored on the sea bed within an offshore complex of the kind described in Swedish Patent Specification 447 141. In this case, the secondary capsules will preferably be somewhat smaller than the secondary capsules aforedescribed, for instance capsules having a displacement of about 2000 tonnes.

An advantage is afforded when the secondary capsules are trimmed with the aid of the ballast chambers in a manner such that the capsules will automatically take a position with the axis extending vertically in the water. This is advantageous from a cooling aspect, should a capsule unintentionally or accidentally come loose on the sea bottom.

The invention affords many significant advantages. The storage of environmentally hazardous waste, particularly radioactive waste, in deep waters is in itself an advantage. Another advantage is that very large secondary capsules can be used, thus enabling a large quantity of waste material to be stored. Such capsules also have significant mechanical strength and resistance to external influences. Furthermore, the capsules provide a highly effective screen against radioactive radiation for instance. A waste-storage arrangement constructed in accordance with the invention can be readily monitored with respect to possible leakage of waste material or radiation. When a leak is detected, the secondary capsule responsible for the leak can be readily taken to the surface for closer inspection and subsequent remedial action. This remedial action may consist in either replacing the secondary capsule or primary capsule, depending on whether the leakage is caused by a fault in the secondary capsule or in the primary capsule, whereafter the serviced secondary capsule with the primary capsule inserted therein can be returned to the storage location on the sea bed.

I claim:

1. An arrangement for the underwater storage of hazardous waste characterized in that the arrangement includes at least one substantially cylindrical concrete body (1) provided with a single central storage cavity (3) for accommodating and enclosing waste, and a plurality of ballast chambers (4) which are located in the vicinity of and within the cylindrical surface of said body and distributed around the circumference thereof and which can be filled to varying degrees with water and the total volume of which is such as to enable the body to be brought to a water-buoyant state by emptying said ballast chambers.

2. An arrangement according to claim 1, characterized in that the concrete body (1) is provided with a plurality of inner cooling channels (5) which extend substantially in an axial direction in spaced relationship around the circumference of said body and the respective ends of which channels open in the outer surface of the concrete body.

3. An arrangement according to claim 2, characterized in that the cooling channels (5) are located between the ballast chambers (4) and the storage cavity (3).

4. An arrangement according to claim 1, characterized in that the storage cavity (3) has the form of a hollow shaft which is open at one end and which extends axially and centrally in the concrete body (1); said shaft being intended to receive a waste-containing capsule (2) and thereafter to be sealed at its open end.

5. An arrangement according to claim 1, characterized in that the two ends of the concrete body (1) are substantially hemi-spherical in shape.

6. An arrangement according to claim 1, characterized in that the concrete body (1) is provided with a water-jet propulsion unit for movement of the body in water.

7. An arrangement according to claim 6, characterized in that the concrete body (1) is provided with pump means for varying the volume of water in the ballast chambers (4).

8. An arrangement according to claim 7, characterized in that said water-jet propulsion unit and/or said pump means comprise a unit which can be detachably fitted to the concrete body (1).

9. An arrangement according to claim 1, characterized in that the arrangement further comprises a rigid, single-piece coherent concrete structure (6) having a substantially greater cross-sectional area than height and which is intended to rest on a sea bed and includes a large number of mutually adjacent cylindrical storage spaces (9) which are open at least at their upper ends and each of which is formed to receive a concrete body (1) of the aforesaid kind; and in that the walls of the concrete structure (6) contain a plurality of ballast chambers which can be filled to varying degrees with water and which together have a total volume such as to enable the concrete structure (6) to be brought to a buoyant state in water by emptying the ballast chambers.

10. An arrangement according to claim 9, characterized in that the concrete structure (6) has an annular configuration.

* * * * *